United States Patent [19]

Gillet

[11] 4,424,893

[45] Jan. 10, 1984

[54] METHOD AND INSTALLATION FOR ENCOURAGING THE RESTITUTION OF SHOPPING CARTS IN A SUPERMARKET

[75] Inventor: Guy Gillet, Deols, France

[73] Assignee: Supermarket Systems, St. Lambert des Bois, France

[21] Appl. No.: 213,191

[22] Filed: Dec. 4, 1980

[30] Foreign Application Priority Data

Jun. 23, 1980 [FR] France ..... 80 13884

[51] Int. Cl.[3] ..... G07F 7/06

[52] U.S. Cl. ..... 194/4 C; 186/62

[58] Field of Search ..... 194/4 C, 4 R, 4 E; 221/3; 49/49; 186/62

[56] References Cited

U.S. PATENT DOCUMENTS

| | | | |
|---|---|---|---|
| 3,754,630 | 8/1973 | Gilken | 194/4 |
| 3,837,955 | 9/1974 | Hunt | 194/4 R |
| 3,882,982 | 5/1975 | Smith | 194/4 C |
| 3,938,638 | 2/1976 | Moule | 194/4 C |

FOREIGN PATENT DOCUMENTS 7922835 6/1980 France .

*Primary Examiner*—Stanley H. Tollberg
*Attorney, Agent, or Firm*—Charles E. Temko

[57] ABSTRACT

A method and an installation for encouraging the restitution of a vehicle such as a shopping cart in a reception area the access of which is controlled by wickets. The vehicle is twice identified at the entry of the reception area, by means counting for example the bars of a vehicle side, and causes the delivery of a ticket or the like when it has been identified and fully introduced in the reception area.

23 Claims, 14 Drawing Figures

METHOD AND INSTALLATION FOR ENCOURAGING THE RESTITUTION OF SHOPPING CARTS IN A SUPERMARKET

The present invention relates to a method and an installation for encouraging the restitution of the shopping carts in a supermarket.

It is known that in a supermarket, each buyer has at his disposal a cart which he pushes and in which he places the objects he has chosen on the shelves bordering the circulation lanes; following which the buyer presents himself with his cart to a till where he pays the price of the objects chosen. The buyer removes the objects from the cart immediately after his passage at the till or in another location closer to his car left in the parking place which is often adjacent the supermarket.

However that may be, the empty carts which are present in many locations of the supermarket and even sometimes outside the latter pose a problem for collecting them and putting them again at the disposal of the public, which problem could only be solved hitherto by calling upon a relatively costly personnel.

Systems have been proposed for encouraging the users to bring back themselves the carts they used to a storage station, and which foresee to hand over to the user who has brought back his cart to the stipulated location a voucher attesting the return and the subsequent presentation of which gives him the right to an advantage of some sort.

The installations used till now for putting into effect these systems are complex, difficult to keep in good order and do not offer sufficient security against fraudulent attempts from some users. They comprise generally mechanical devices fixed to the ground, for recognizing the shape of vehicles introduced in a storage area, but which do not exclude the possibility of a fraud, and which admit only the carts of the type for which they have been set.

The object of the present invention is to remedy the disadvantages of the existing installations and a particular object is a method for avoiding frauds in the restitution of carts, characterized in that:

at least one first identification of the cart is carried out in an access area, upstream of a barrier;

at least one second identification of the cart is carried out after, during the restitution and when penetrating the access area, the barrier permitting the eventual withdrawal of the cart as long as it remains at the level of said barrier;

the barrier is allowed to return to its closed condition as soon as the cart is no more at the level of said barrier.

and a distributor of tickets or similar is then caused to operate.

The withdrawal of the cart in the upstream direction and before completely crossing the barrier causes the prohibition of the delivery of the evidence means of the restitution of the cart, whereas the complete passage of the cart downstream of the barrier causes, after the closing of the latter, the delivery of the evidence means.

The process according to the invention, further to its efficiency in fighting frauds, allows the user who has inadvertently engaged his cart in the reception area to withdraw it without difficulty, which result could not be obtained with the known installations in which the beginning of the introduction of the cart in the reception area caused its blockage and the impossibility to withdraw it.

According to an important aspect of the invention, the first identification being accomplished, either the second identification is not carried out at the end of a predetermined period of time, causing the locking of the barrier or any other closing member; or at the end of said period the second identification is in the course of being carried out, in which case the barrier remains in a unlocked condition.

Likewise, and still according to the invention, the second identification is carried out within a predetermined period of time, beyond which:

if the second identification is conclusive, the re-locking of the barrier is accomplished after the passage of the cart downstream, the evidence means being then delivered, if, on the other hand, the second identification is not conclusive, the delivery of the evidence means is inhibited.

According to another interesting aspect of the invention, the first and second identification are carried out by the optical detection of determined geometrical characteristics of the cart being restituted.

More precisely, the identification of the cart is effected by a measurement made on said cart, during the relative displacement of the cart and of an appropriate identification unit.

In the particular case of lattice-work carts such as those usually present in shops and supermarkets, the first and second identifications are carried out by counting a number of vertical, or substantially vertical, bars of the cart.

On the other hand, according to an important feature of the invention, the counting of the bars is carried out only on one side of the cart, thereby avoiding identification errors in the case where the cart could be wrongly introduced.

The invention relates also to an installation for carrying out the hereabove method for the restitution of shopping carts or similar in a closed reception area, with an access controlled by a barrier which is retractable and eventually lockable.

Such an installation comprises at least a first cart recognition equipment, placed upstream of an access control device or barrier, a second cart recognition equipment, situated between the first identification equipment and the access control device, eventually a locking means for immobilizing the access control device in the access prohibition position (the opening of said locking means being controlled by the first recognition equipment), a control system of the device, particularly of the barrier or wicket, allowing the retraction of the latter only in the downstream direction and its return to the access prohibition position, a member sensitive to the closed condition of the barrier and an unit checking the correct sequential progress of the operations which control the distributor of the evidence means.

According to a preferred embodiment of the invention, the first and second recognition equipments comprise respectively an infra-red rays device the transmitter and receiver of which are placed on either side of the access to the reception area, so that, in the case of a lattice-work cart, the recognition of said cart is carried out by counting the bars forming one of the side flanks of said cart.

According to one mode of execution, the transmitter and receiver of each infra-red device are staggered in height one relative to the other so that the beam transmitted is inclined relative to the horizontal reference plane on which moves the cart towards the reception area, one of the elements of the device being at a level higher than the upper edge of one side of the cart, while the other element of the device is lower than the upper edge of the side of the cart.

The overall dimensions of the carts are not uniform and the invention foresees, for taking in account only the bars of a cart on one side of said cart, that the top element of the infra-red rays device is situated higher than the edge of the cart having the largest overall dimensions, while the bottom element of said device is below the edge of the cart of minimum overall dimensions.

Preferably, the transmitter and the receiver of each device are mounted adjustable in height on substantially vertical supports for allowing their adaptation as a function of the types of carts to be checked.

For the recognition of the carts, a pair of infra-red cell devices is associated with an unit counting the signals transmitted by the receiving cells, said disposition avoiding the frauds consisting for example in displacing the cart in successive alternate motions in front of the cells for trying to cause the opening of the door of the reception area.

In the following description which is given by way of example, reference is made to the accompanying drawings in which.

Herebelow is described an installation foreseen for receiving shopping carts commonly used in supermarkets, but it should be understood that other applications of the invention may be made without departing from the scope of the present application.

A cart reception area comprises an access corridor to which are connected on either side tubular elements which are part of an enclosure bounding said area.

Figure 2:
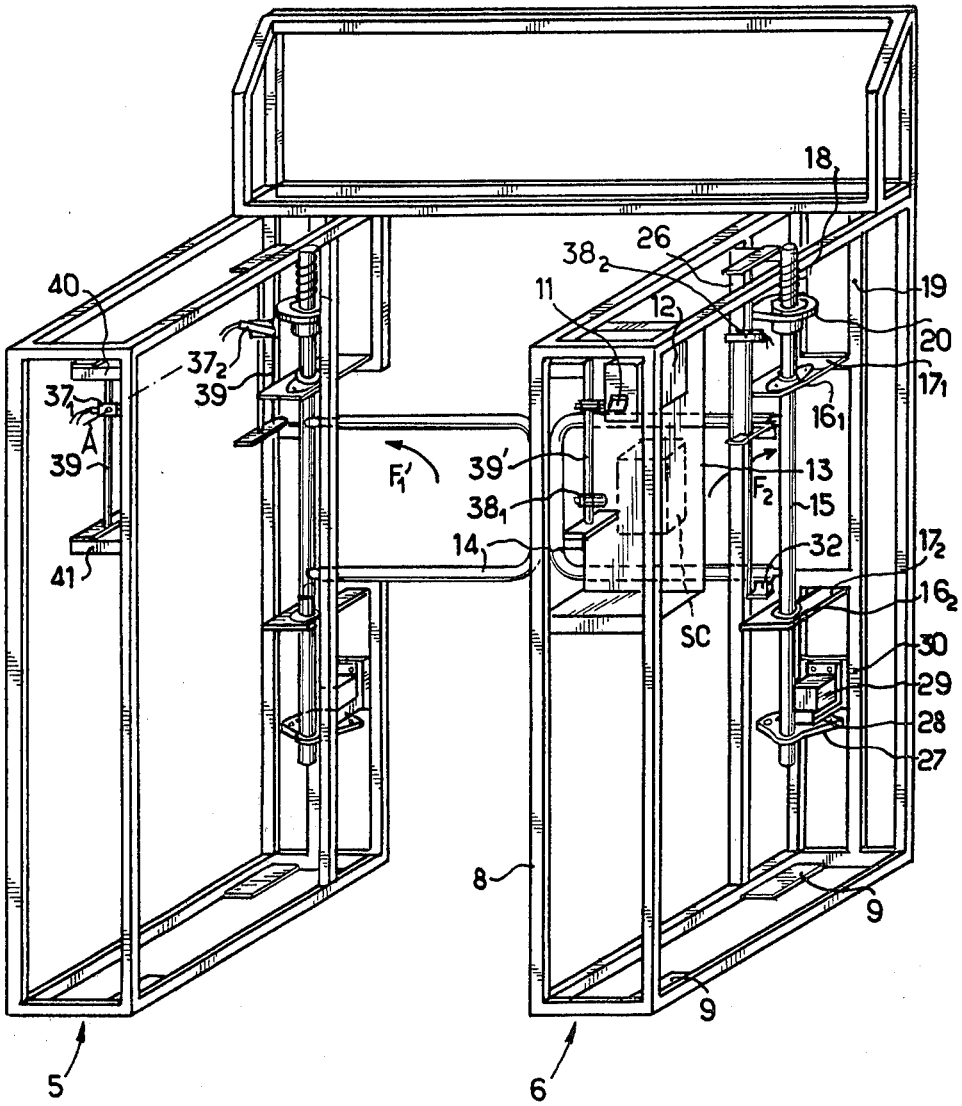
FIG. 2 is a schematic view of said installation, after the removal of the casings or cladding plates.

The access zone or gate of the reception area is bounded by two side boxes 5 and 6 parallel to each other and connected at their upper rear portions by a transverse chest 7, the assembly having in a horizontal projection the shape of a U. The boxes 5 and 6 as well as the chest 7, of general parallelepipedal shape, may be made in any appropriate manner, particularly from a folded steel sheet, or they may comprise a metallic ossature such as in shown in FIG. 2, covered by a casing concealing and protecting the inner members. The assembly is attached to the ground by lower fixation gussets 9.

Figure 1:
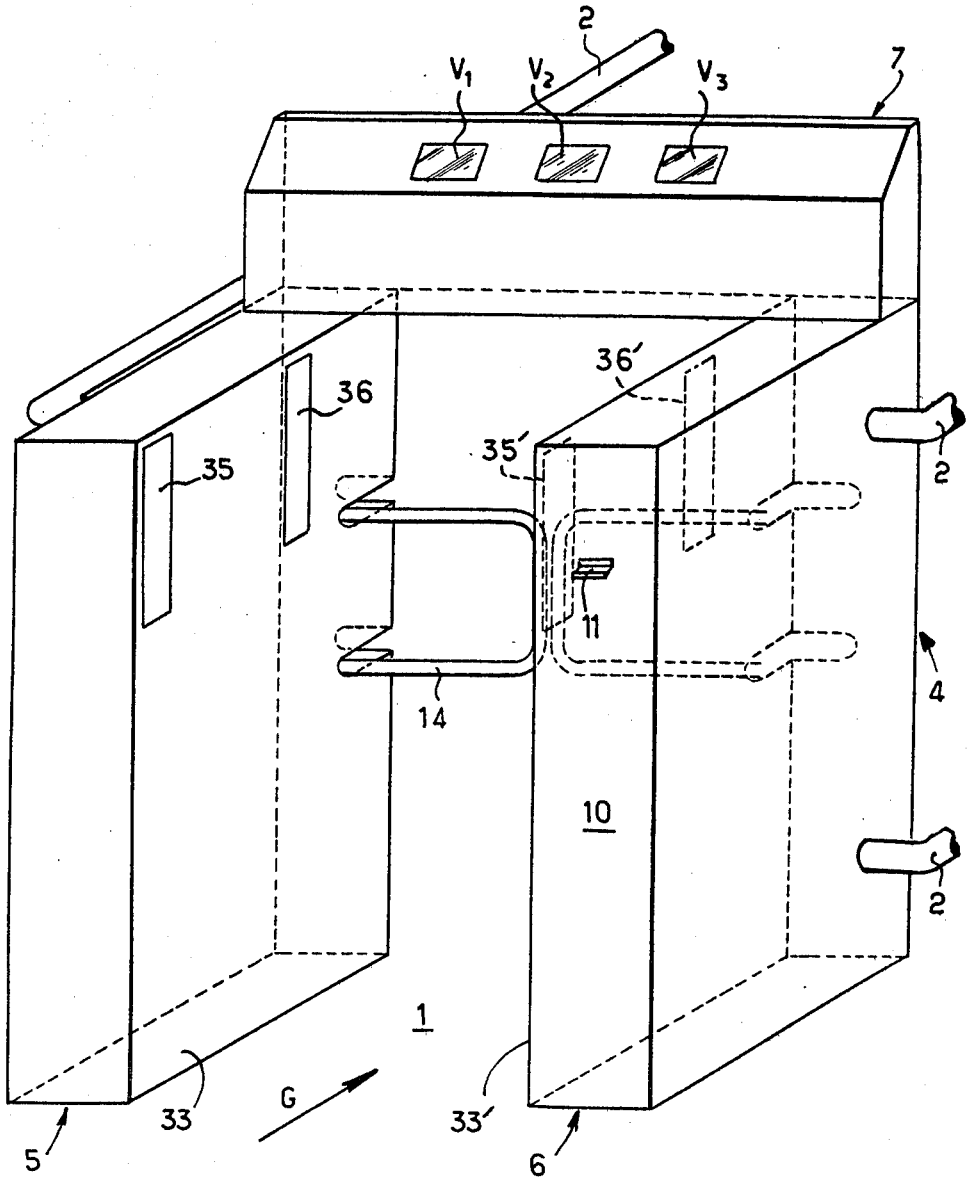
FIG. 1 is a perspective schematic view of an installation according to the invention for checking the entry in the cart storage area in a supermarket.

On the frontal face shown at 10 of one of the boxes, for instance box 6 of FIG. 1, is, substantially at the height of the hand of a standing man, a pan 11 placed at the outlet of a chute and adapted for receiving a ticket delivered by the machine once the user has introduced his cart in the reception area.

The chute is part of a ticket distributor 12 comprising in a standard manner a driving motor which drives forward, step by step, a roll of pre-sized paper, a guillotine cutting the paper and supplying a ticket at each operation, the ticket being then carried over through the chute to the user. Said ticket distributor 12, which is not shown in detail since it is well known, is mounted inside the box 6, in a place out of access for the user, on a plate 13 secured with bolts to the ossature and adapted for receiving also electronical members needed for the operation of the installation and referenced SC.

The access gate to the reception area is normally closed by two wickets 14 pivotally mounted at their outer edge about vertical axes and adapted for opening, from their closed condition where their inner edges are joined, only in the downstream direction, as is shown by the arrows $F_1$, $F_2$. With each of said wickets associated a control mechanism contained in one of the boxes 5 and 6. Said mechanisms are identical, and one only will be described hereafter.

In the example shown, each wicket is made of a tube bent in the shape of a U, attached to a vertical shaft 15 rotatably mounted in bearings $16_1$, $16_2$ mounted on supports $17_1$, $17_2$ fixed to the frame of the box 6 or 5. At the upper end of the shaft 15 is attached a return spring 18 the other end 19 of which is bearing against a fixed portion of to ossature. Said spring returns automatically the wicket, once it has been opened, in the closed condition shown in FIG. 2.

Figure 5:
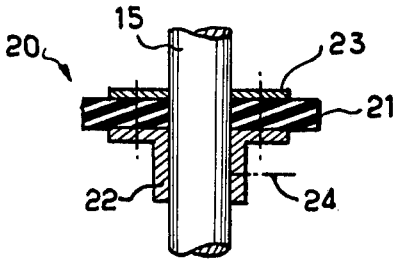
FIG. 5 is a sectional view at a large scale of a braking device of the wicket.
Figure 6:
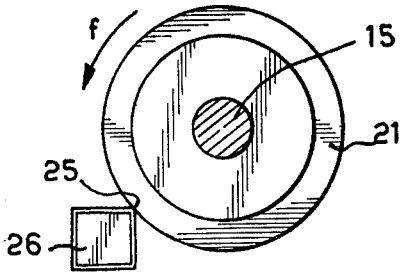
FIG. 6 is a corresponding plan view.

In order to avoid rebounds when the wicket is returning to its closed condition, a damping device generally referenced 20 is foreseen, said device being keyed onto the shaft 15 and formed simply (FIGS. 5 and 6) by a disc 21 of a flexible material such as rubber, sandwiched between a sleeve 22 secured by a screw shown schematically at 24 on the shaft 15 and an upper disc 23, the disc 23 and the sleeve 22 being rigidly connected by screws. The outer edge of the rubber disc 21 is constantly bearing against a ridge 25 of a small cubic block 26 of the fixed frame, so that said two elements rub against each other when the wicket is closed back, the shaft 15 turning then in the direction of arrow $f_2$ (FIG. 6).

Figure 4:
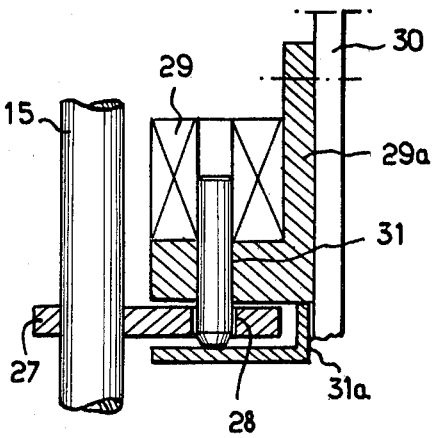
FIG. 4 is a sectional view at a larger scale of a locking device of an access wicket.

On the other hand, the wicket 14 may be maintained in a closed condition by a locking device shown in detail in FIG. 4. On the lower end of the shaft 15 is keyed a part 27 in the shape of a sector, formed with holes 28. Said part 27 is situated under a support *29a* secured to the frame 30 of the box and carrying an electromagnet 29 the mobile core 31 of which is slidably engaged inside a hole of a support *29a* and is adapted for protruding downwardly by entering one of the holes 28 of part 27 which is rigidly connected to the shaft 15.

An abutment 31*a*, situated under the part 27, provides a limit for the stroke of the core 31.

On the frame of the boxes 5 and 6 are also foreseen fixed switches 32 operated by the wickets when they pivot and playing the role of presence detectors of the wickets.

The faces in register 33 and 33' of the two boxes 5 and 6 comprise opening, respectively 35, 36, 35', 36' (FIG. 1) each closed by a "Plexiglas" panel (methylmethacrylate), through which can pass the infra-red rays, and thereby concealing the inside of the cases to the users. Behind said panels are housed transmitters and receivers which are part of the infra-red devices.

Two devices are foreseen, one the cells of which are behind the openings 35 and 35' and the other cells of which are behind the openings 36 and 36'. Each device comprises a transmitter 37 and a receiver 38, respectively $37_1$ and $38_1$ (FIG. 2) behind the openings 35 and 35', and $37_2$ and $38_2$ behind the openings 36 and 36'. Each transmitter and each receiver is slidably mounted on vertical small columns, respectively 39 and 39' placed between the supports 40, 41 secured to the fixed frame of the installation. Such a disposition allows a height adjustment of each transmitter and of each receiver.

On the other hand, each transmitter and each receiver is also adjustable by rotating about a horizontal axis A parallel to the mean longitudinal plane of the installation. This double possibility of adjustment of the positions of the transmitter and receiver allows on the other hand an adaptation of the installation to various overall sizes of the shopping carts, as is seen with reference to FIG. 3, and on the other hand to carry out a recognition of the nature of a cart only on one side thereof.

Figure 3:
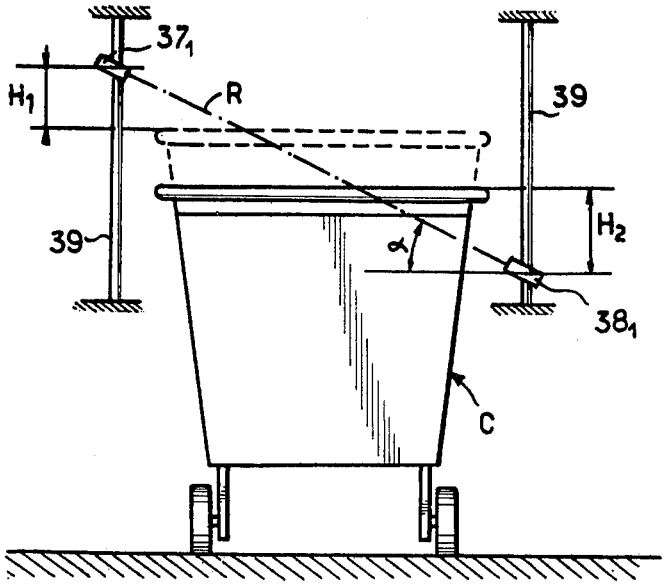
FIG. 3 is a schematic elevation of an indentification equipment of the carts.
Figure 7:
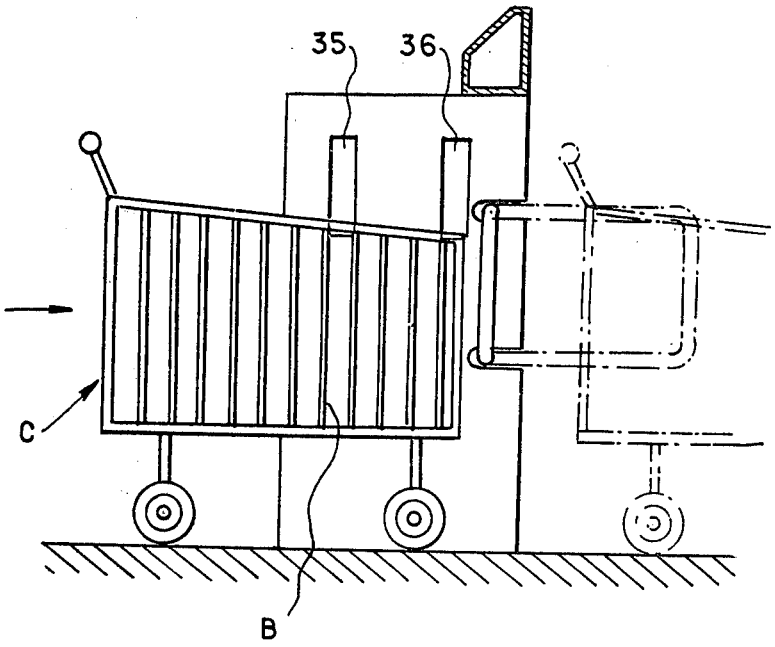
FIG. 7 is a schematic view showing the installation in a longitudinal cross-section at the moment where a cart is ready for being introduced in the access area or gate.

In FIG. 3 is shown in plain lines the cart of smallest overall dimensions and in interrupted lines a cart of maximum overall dimensions. The cart C (FIG. 7) has sides or flanks formed by vertical or substantially vertical bars B. For adjusting the installation, one places the transmitter $37_1$ at a level which is higher by a distance $H_1$ than the upper edge of the cart of maximum overall dimensions and one places the receiver $38_1$ at a level which is lower by a distance $H_2$ than that of the upper edge of the cart of smallest overall dimensions. Under such conditions, whatever the dimensions of the cart used, the rays transmitted by the transmitter $37_1$ to the receiver $38_1$, as is shown at R, meet only one side of the cart C whose overall dimensions are comprised between the cart of maximum overall dimensions and the cart of minimum overall dimensions. It is thus possible to carry out limitatively the counting of the bars on the right hand side of the cart, and the bars of the left hand side cannot be taken in account by the counting even if the cart is presented obliquely, that is according to a movement which is not strictly parallel to the symmetry mean vertical plane of the installation.

The same applies to the cooperation of transmitter $37_2$ with receiver $38_2$.

On the front face of the console or transverse chest 7 are foreseen three signal lights $V_1$, $V_2$, $V_3$ (FIG. 1). When the signal light $V_1$ is green, this means that the installation is ready for the introduction of a cart in the gate.

The signal light $V_1$ (green) is lighted during the whole duration of the cycle and, consequently, is turned off only during the delivery of the ticket.

When the signal light $V_2$ is red, it is a sign of an out of service condition of the installation. When the signal light $V_3$ is red, it is the sign of the necessity of re-feeding the machine with a roll of ticket paper.

A fourth signal light may be foreseen also, which, when red, signals that the reception area cannot receive any new cart.

The operation is the following:

When an user wishes to restitute a cart he has used for his purchases and which he has emptied of the commodities he has bought, he comes to the gate 1 for introducing the cart inside the storage area. After having seen that the signal light $V_1$ is lighted, thereby pointing out that his cart can be introduced in the installation, he moves the cart forward by pushing it in the direction of arrow G of FIG. 1. When the front portion of the cart arrives in front of the first checking device, it stops the beam transmitted by the transmitter $37_1$ towards the receiver $38_1$ of the device, thereby enabling the start of the cycle. The first counting of the vertical bars B of the cart C is carried out by the first device $37_1$, $38_1$, so as to carry out a first identification. if the number of bars counted by the first device (for example four or five) corresponds to a predetermined or recorded number in the installation for allowing the operation cycle to proceed, the wickets 14, which where hitherto locked in a closed condition, are unlocked through the energization of the electromagnets 39 of the locking devices; the cores 31 are attracted and thereby free the part 27 which is rigidly connected to the shaft 11. In an alternative embodiment, for reducing still more the risk of a fraud, the unlocking of the wickets is controlled by the association of two detection systems, viz. $37_1$ and $38_1$ on the one hand, and $37_2$, $38_2$ on the other hand.

The wickets being unlocked, the user needs only to go on moving his cart forward for pushing back the wickets in the downstream direction of the installation and thereby to open them. The wicket presence checking switches 32 which were in a closed position change then of state and enable the second transmitter receiver device $37_1$, $38_2$ which starts counting the vertical bars B of the cart. When the number of bars counted by the second device reaches a predetermined value, recorded previously in the installation and corresponding to the second identification of the cart, the user needs only to go on moving his cart forward so that the latter completely passes the wickets, said wickets being then able to return to their closed position through the agency of the return springs 18.

The cart is then inside the reception area.

The wickets, on closing, control the switches 32 which authorize the locking of the wickets by energizing the electromagnets 29 of the doors locking devices.

The whole of the process having been effected normally and the cart having been restituted, the installation then delivers a pre-sized voucher which the user can collect in the pan 11.

The whole operation cycle of the installation calls upon time-delays allowing to check the relative durations of each phase of the progress of the cart.

Any fraud attempt, resulting notably in a counting anomaly, brings about the inhibition of the delivery of a ticket with eventually and in association the triggering of an alarm in the case where the wickets remain open too long.

The there and back movements of the same cart may be checked by the first device which starts to count again and reaches then a predetermined number of bars counted for which the blocking of the ticket delivering process is started.

An user having introduced a cart by mistake between the wickets can withdraw it as long as the cart has not been totally engaged and as long as the wickets are not closed again. But in this case, the installation does not deliver a ticket.

Advantageously, the installation comprises a summation counter with resetting to zero, allowing to count the number of tickets distributed.

Figure 8:
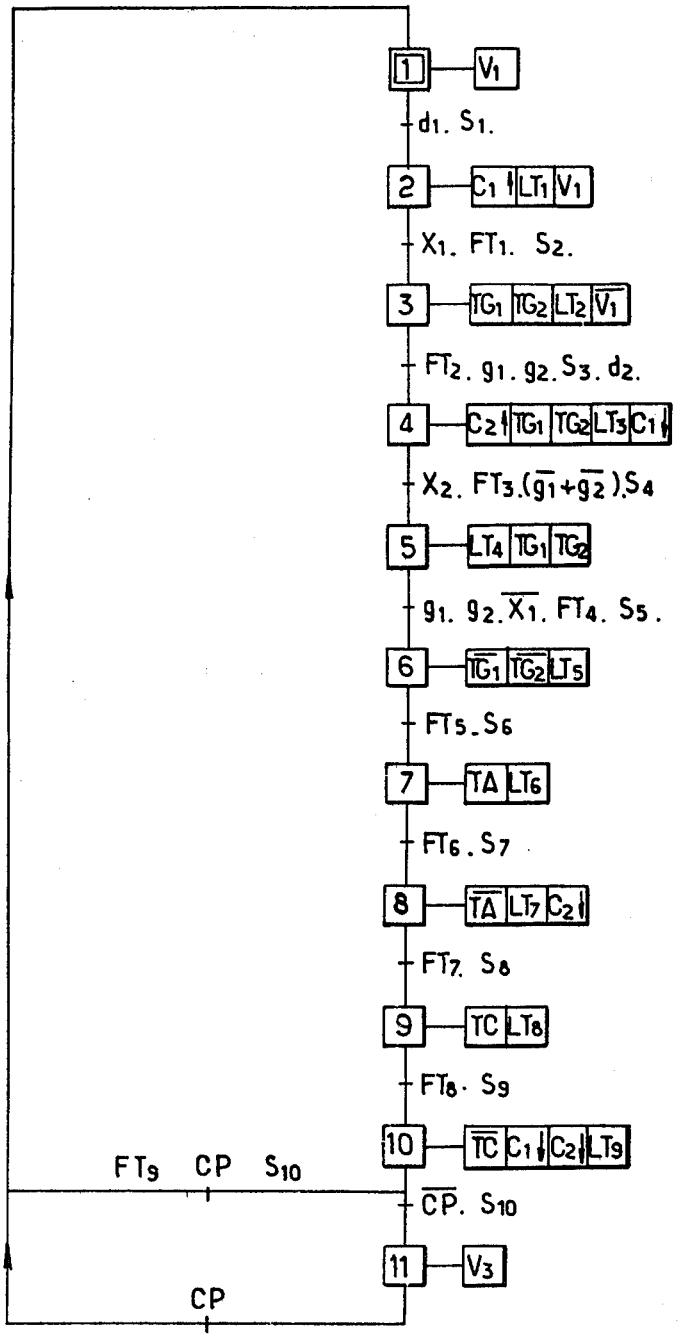
FIG. 8 is a diagram representative of the operation cycle.

In the table of FIG. 8 relative to a normal operation cycle of the installation, the numbers 1 to 11 represent the various operation phases in their succession in time.

The numbers, on the left hand side of the table, designate in succession and in the increasing order the various steps of the operation. The indications in squares connected to a number by a line show schematically the operations of the step designated by said number.

The indications between two consecutive numbers relate to the operations carried out between two steps of the process, or inter-step operations.

A—Step No. 1 it corresponds to the start of a cycle, when the installation is in the position of FIG. 1, adapted for receiving a cart.

At this stage, the signal light $V_1$ (green) is lighted, meaning: "Introduce your cart".

B—Inter-step 1.2 the user begins to introduce his cart in the access gate and the front part of the cart causes the first black-out of the first infra-red device $37_1$–$38_1$, bringing about the starting authorization of the cycle. $S_1$ is the validation indication of the previous step, each step having to be previously enabled prior to the accomplishment of the following step. In the present step, the validation consists in checking that the signal light $V_1$ is actually lighted.

C—Step No. 2 the user goes on progressing, which causes simultaneously as schematically shown by $C_1$ (arrow), the first counting of the cart bars by the cells $37_1$, $38_1$;

as schematically shown by $LT_1$, the beginning or start of the time delay from the beginning of the first counting.

The signal light $V_1$ remains lighted.

D—Inter-step 2.3

$X_1$ represents the predetermined number of bars prerecorded in the installation and which has been counted as a minimum by the device comprising the cells $37_1$, $38_1$ within a predetermined period of time.

$FT_1$ represents the end of the time delay related to the first counting which has to be over before the passage to the following stage.

$S_2$ represents the validation of the operation of step 2.

E—Step No. 3 the correctness of the operations of the inter-step 2.3 being checked, the members (for example the transistors) $TG_1$ and $TG_2$ controlling the unlocking of the right hand and the left hand wickets are energized.

$LT_2$ represents the starting of the time delay for the end of the first counting, time delay during which the first black-out of the beam of infra-red rays transmitted by the transmitter $37_2$ to the receiver $38_2$ has to be effected.

$\overline{V_1}$ shows that the signal light $V_1$ is turned off.

F—Inter-step 3.4

$FT_2$ indicates the end of the time delay concerning the time interval separating the end of the first counting and the first black-out, by the front end of the cart, of the infra-red beam transmitted by the transmitter $37_2$ to the receiver. The wickets are unlocked but the user has not opened them. The switches 32, symbolized by $g_1$ and $g_2$, have not yet changed state.

$S_3$ shows the validation of the previous step.

$d_2$ shows the first black-out of the infra-red beam transmitted by the transmitter $37_2$ to the receiver $38_2$.

G—Step No. 4 the counting device being energized by the device $37_2$, $38_2$, the second counting $C_2$ (with an arrow pointing upwards) is started.

The transistors $TG_1$, $TG_2$ controlling the wickets remain actuated.

The time delay ($LT_3$) for the beginning of the second counting is started.

The first counting $C_1$ (with an arrow pointing upwards) is set back to zero.

H—Inter-step 4.5

$X_2$ represents the predetermined number of bars which have been counted as a minimum by the second device $37_2$, $38_2$ during a predetermined period of time.

$FT_3$ represents the end of the time delay of the second counting, which has to be carried out before passing to the next stage.

The switches 32 have changed state, which is materialized by $(\overline{g_1}+\overline{g_2})$.

$S_4$ indicates the validation of the previous step.

I—Step 5

$LT_4$ indicates the starting of the time delay of the second counting, during which the wickets have to close back. $TG_1$, $TG_2$ indicate that the control transistors for the wickets remain actuated, the wickets being open.

J—Inter-step 5.6 the cart having totally passed, the wickets close back and actuate the switches 32 which change state and close, which is materialized by $g_1$, $g_2$.

$\overline{X_1}$ indicates that the delivery of the voucher is inhibited in the case of a new score made by the first device comprising the transmitter $37_1$ and the receiver $37_2$.

$FT_4$ represents the end of the time delay relating to the interval of time which has to elapse between the end of the second counting and the moment where the switches 32 close.

$S_5$ signals the validation of the previous step.

K—Step No. 6 the control transistors for the doors are no more energized, which is materialized by $\overline{TG_1}$, $\overline{TG_2}$.

$LT_5$ indicates the starting of the time delay between the closing of the wickets and the beginning of the movement forward of the paper distributed by the distributor 12.

L—Inter-step 6.7

$FT_5$ signals the end of the time delay between the closing of the wickets and the beginning of the movement forward of the paper delivered by the distributor 12.

$S_6$ indicates the validation of the previous step.

M—Step No. 7

At that moment, the movement forward of the paper is started (particularly by the energization of a transistor), which is materialized by TA.

$LT_6$ indicates the simultaneous starting of the time delay for the movement forward of the paper.

N—Inter-step 7.8

$FT_6$ signals the end of the time delay for the movement forward of the paper.

$S_7$ indicates the validation of the previous step.

I—Step No. 8

The movement forward of the paper is interrupted, which is symbolized by $\overline{TA}$. The time delay $LT_7$ between the end of the movement forward of the paper and the beginning of the cutting operation of the latter is started.

$C_2$ followed by the arrow pointing downward indicates that the second counting is taken in account by the apparatus.

P—Inter-step 8.9

$FT_7$ signals the end of the time delay between the end of the movement forward of the paper and the beginning of its cutting.

$S_8$ indicates the validation of the operation of step 8.

Q—Step 9 the paper cutting device and the summation counter of the tickets distributed are then set going, notably by the energization of a transistor, which is materialized by TC.

$LT_8$ indicates the starting of the time delay for the operation of the paper cutter.

R—Inter-step 9.10

$FT_8$ represents the end of the time delay before starting the paper cutting device.

$S_9$ signals the validation of the operations of step 9.

S—Step 10

TC indicates that the paper cutting device and the ticket summation counter are disconnected.

$C_1$, and $C_2$, both being accompanied by an arrow pointing downwards, indicate that the first and second counting operations are taken in account.

$LT_9$ signals the starting of the time delay for the checking of the paper.

T—Inter-step 10.11

$S_{10}$ indicates the validation of the operation of the preceding step.

$FT_9$ indicates the end of the time delay for checking the paper.

Then, one checks the presence of the paper in the machine.

Two cases may occur:

(a) if there is still paper, CP (checking means for the presence of paper) remains energized;

(b) if there is no more paper, the paper presence checking means signal it, which is materialized by $\overline{CP}$.

U—Step 11

This step occurs only in the case where there is no more paper in the machine. The signal light $V_3$ is lighted, thereby signalling the necessity of putting new paper in the machine. After having placed a new paper roll, the checking means come to their normal state which is materialized by CP.

A new operation cycle may then start again.

The invention foresees an alternative embodiment in which, as a function of the chosen tickets or vouchers distributer, a single pulse is used for the delivery of a voucher, which allows not to take in account the starting of the paper cutter operations.

Figure 11:
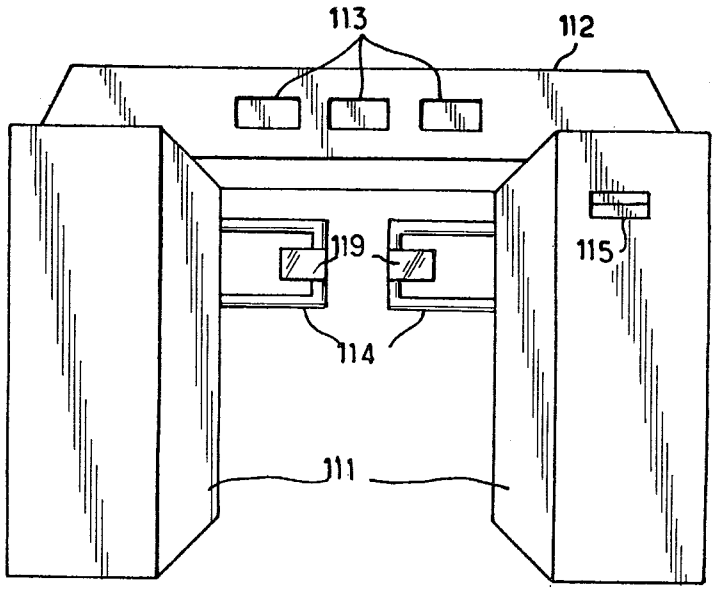
FIG. 11 is a similar view to FIG. 9, but showing another alternative installation.
Figure 9:
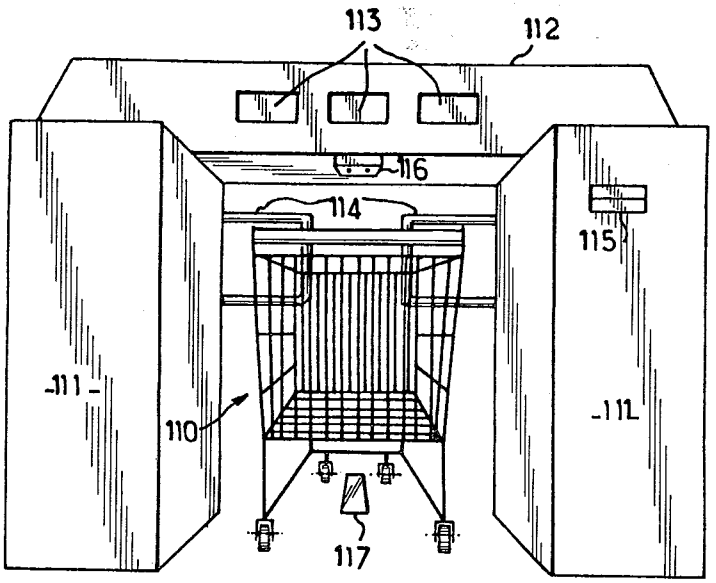
FIG. 9 is a schematic view of an alternative embodiment of the installation for the restitution of carts in a supermarket, foreseen at the entry of a storage area.
Figure 10:
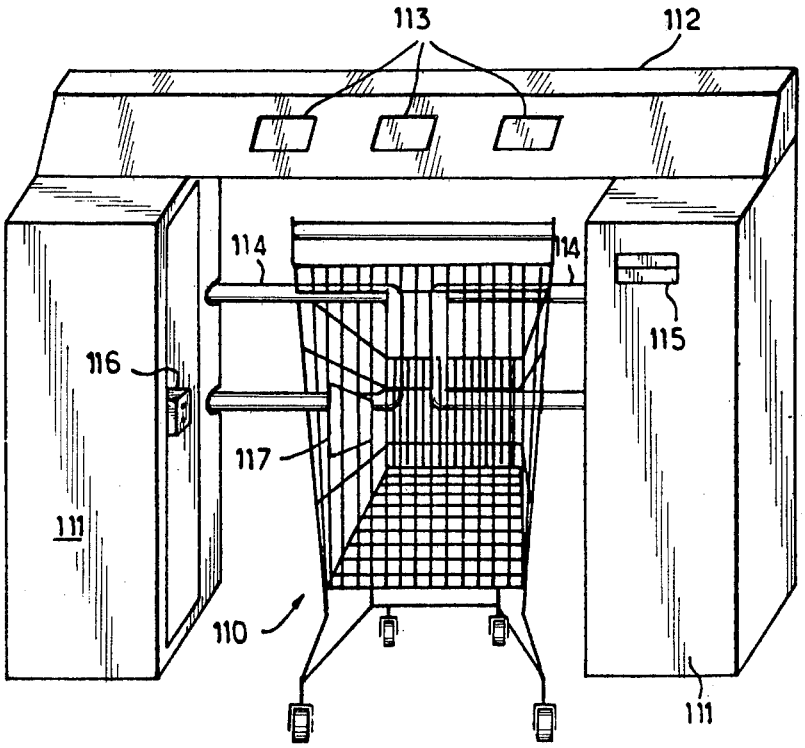
FIG. 10 is a similar view of FIG. 9, but showing an alternative installation.

With reference to FIGS. 9 to 11, a description will now be given of alternative embodiments of the installation according to the invention.

In FIG. 9 is schematically shown a portion of an installation for the restitution of a cart 110, foreseen at the entry of a cart storage area, to which the public has no access. It comprises a porch bounding a cart introduction opening, and which is formed of two vertical pillars 111 spaced apart from each other by a distance which is greater than the width of a cart 110, and connected at their upper end by a horizontal transverse beam 112 comprising a number of signal lights 113 for signalizing the progress of the various operations carried out by the installation and its operation state. At its rear end, situated on the side of the storage area, the installation comprises a barrier or wicket with two leaves 114 which normally close the access to the storage area and which are adapted for being opened by a cart 110 pushed by an user under the porch 111, 112.

Various recognition means for the cart 110 are foreseen upstream of the wicket 114 and are generally operating sequentially, so as to carry out a certain number of cart identification operations, in a determined order, when the cart is pushed against the wicket 114. If these operations are carried out in the determined order and advantageously within a determined period of time, they start the operation of a ticket distributor housed in one of the pillars 111 and delivering a ticket through a slot 115 of the front face of said pillar. The ticket gives the user who has brought his cart 110 back to the storage area the right to a reward or an advantage of some sort of nature.

One at least of the cart 110 recognition means is a photo-electric cell of the so-called "reflection" type comprising a casing 116 containing, side by side, a transmitter transmitting a radiation of determined wave length, for example an infra-red radiation, and a receiving element for the detection of a said radiation or the reflection of the latter on a reflector 117.

In the example of FIG. 9, the casing 116 is mounted on the lower horizontal face of the transverse beam 112 and the reflector 117 is on the ground, on the passage of the cart 110, in vertical alignment with the casing 116.

It is to be understood that when the cart 110 is brought in front of the wicket 114 between the two pillars 111, some of its parts pass in succession between the reflector 117 and the casing 116 and prevent the reflection of the radiation towards the receiving cell of the casing 116. The presence of the cart 110 in front of the wicket 114 and its passage above the reflector 117 are thus detected and taken in account.

In the alternative embodiment shown in FIG. 10, the installation comprises a porch 111, 112, of the same type as previously, and the casing 116 containing the reflection photo-electric cell is placed, not on the transverse beam 112, but on the inner face 118 of one of the pillars 111, while the reflector 117 is carried by one of the side walls of the cart 110, the casing 116 and the reflector 117 being at the same height above the ground.

In another alternative, one uses the casing 116 without associating it with a particular reflector, and it is the various portions of the cart 110, when they are opposite the casing 116, which play the role of a reflector.

In a further alternative, shown schematically in FIG. 11, at least one of the cart recognition means is a metal detector 119, of standard type, which is mounted on a leaf 114 of the wicket. In the example shown, each leaf 114 carries a metal detector 119. When the cart 110 is pushed on the wicket leaves 114, its front portion comes substantially in engagement with the detectors 119, which take in account the presence of the cart. When the cart is pushed in order to turn the wicket, the metal detectors 119 remain substantially in engagement with some portions of the side walls of the trolley, and take in account the passage of said cart under the transverse beam 112 of the porch.

For making easy the introduction of a cart in the storage area, the invention foresee also to place behind the porch 111, 112 automatic driving or conveyor means for the cart.

Figure 12:
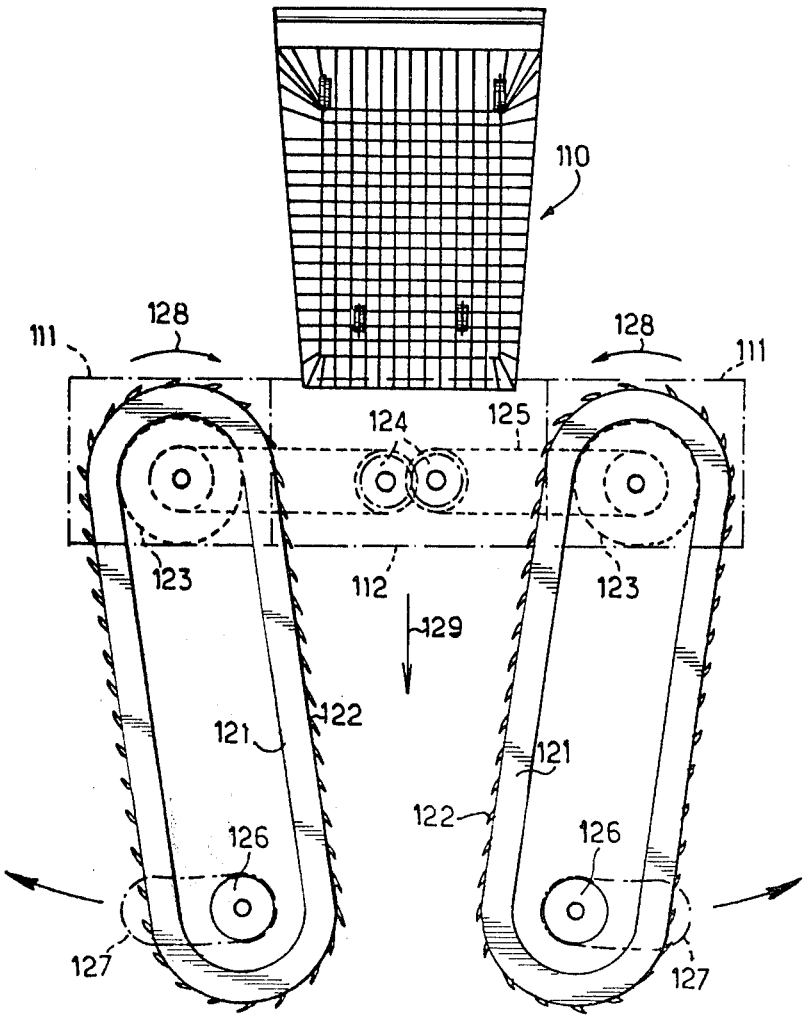
FIG. 12 is a schematic top view showing a cart conveyor according to the invention.

In the embodiment shown in FIG. 12, the conveyor comprises two horizontal belts 121 with a notched or serrated outer surface 112, extending from the porch 111, 112 (shown in phantom lines), on either side of the introduction passage of the cart 110 to the storage area. At their forweard end, the belts 121 run around a driving pulley 123 fixed on a vertical driving shaft which is driven in turn by a motor, for example electrical, by means of a system having pinions 124 and belts 125.

At their opposite end, the belts 121 run around an idle pulley carried by a vertical shaft, the end bearings 126 of which are guided inside curved openings 127 and are subjected to the action of a return springs urging the rear ends of the belts 121 towards each other, so that the latter define a guiding path for the cart 110 which is wider at its inlet end for the cart than at its outlet end for said cart. The distance between the two belts 121 at the level of the porch 111, 112 is larger than the larger width of a cart 110, while the minimum distance between said two belts at their opposite end is substantially equal to the smallest width of a cart.

The device operates in the following manner: when a cart 110 is brought under the porch 111, 112, the cart identification means foreseen in the porch start the operation of the conveyor, the belts 121 being driven by the pulleys 123 in the direction shown by the arrows 128. When the user goes on pushing the cart 110 under the porch 111, 112, the forward end of the cart comes in engagement with the opposite surface of the notched belts 121, and the cart is driven automatically, in the direction of arrow 129, until it comes out of the conveyor. The latter stops then automatically.

Figure 13:
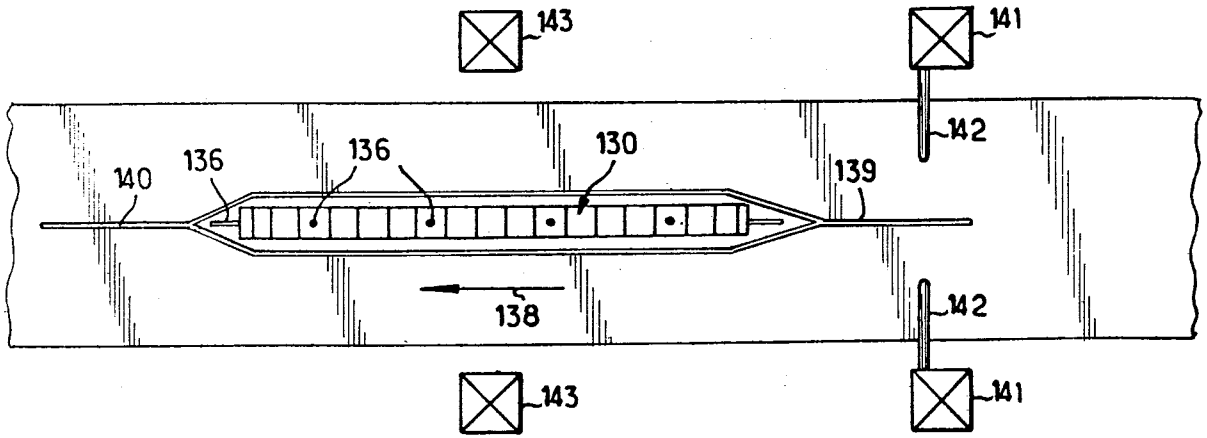
FIG. 13 is a top schematic view of another cart conveyor of the invention.
Figure 14:
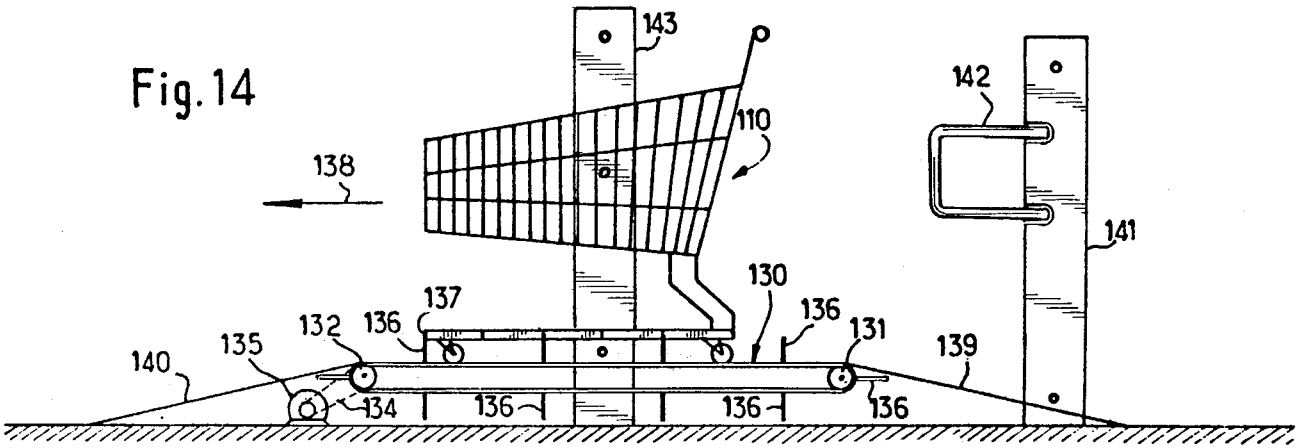
FIG. 14 is a side view of the conveyor of FIG. 13.

In the alternative shown in FIG. 13 and 14, the conveyor comprises a single belt 130 running at its ends over rollers 131 and 132 with horizontal axes, carried by a frame slightly raised relative to the ground 133. The roller 132 is a driving roller, driven through a belt 134 by a motor 135, while the other roller 131 is a simple idle roller.

The belt 130 driving the trolley 110 comprises from place to place on its outer face perpendicular fingers 136 adapted for cooperating with the front transverse bar 137 of the lower portion of the cart, for driving the latter in the direction of the arrow 138. The belt 130 is preceded by a sloping plane 139 and is followed by another sloping plane 140, facilitating bringing the cart 110 on the conveyor, and its removal at the outlet of said conveyor.

In this embodiment, the porch foreseen at the entry to the storage area is substituted by two vertical pillars 141 comprising identification means for the cart 110, and the leaves 142 of the wicket.

Two other vertical pillars 143 may be foreseen inside the storage area, on either side of the conveyor, for controlling the stopping of said conveyor.

This device operates in the following manner:

The user bringing back the cart 110 pushes the latter onto the leaves 142 of the wicket and engages the front of the cart on the sloping plane 139. The passage of the cart in front of the vertical pillars 141 starts the operation of the conveyor and the driving of the belt 130, one finger 136 of which comes in abutment against the lower transverse bar 137 of the front of the cart, and drives the cart in the direction of arrow 138. When the cart 110 passes between the two other vertical pillars 143, it crosses for example the feeding beam of a photoelectric cell which then causes the stoppage of the conveyor, with a time delay which is more or less important as a function of the disposition of the pillars 143 relative to the conveyor end. The cart is moved away by the sloping plane 140 at the outlet of the conveyor.

I claim:

1. A method for encouraging the restitution of a rolling cart in a reception area the access of which is controlled by openable wickets, the encouragement being expressed by the delivery of a ticket following the restitution of the card, wherein:

a first checking of the identity of the cart is carried out upstream of the wickets;

a second checking is carried out when the cart opens and passes the wickets, the wickets allowing during this passage an eventual pulling back of the cart from the reception area; the wickets being allowed to come back to a closed condition once the cart has passed; the distribution of a ticket is inhibited if the cart is pulled back during the second checking, and is carried out if the first and second checking are conclusive and the wickets are closed after the entry of the cart into the reception area.

2. A method according to claim 1, wherein the first checking is carried out within a perdetermined period of time beyond which, if the second checking is not conclusive, the distribution of a ticket is inhibited.

3. A method according to claim 1, wherein the second checking is carried out within a predetermined period of time beyond which, if the checking is conclusive, the distribution of a ticket is made.

4. A method according to claim 1 wherein the wickets are lockable in a closed condition and are unlocked if the first checking is conclusive and are again locked in their closed condition after the entry of the cart in the reception area.

5. A method in accordance with claim 1, wherein the first and second checkings are carried out by the optical detection of predetermined geometrical characteristics of the cart.

6. A method in accordance with claim 5, wherein the detection is that provided by infra-red rays.

7. A method in accordance with claim 1, wherein the cart is a supermarket lattice-work cart, and wherein the first and second checkings are carried out by counting the number of bars on the body of the cart.

8. An installation for encouraging the restitution of a rolling cart, comprising at least: an access control device adapted to be opened by the cart pushed in the direction of access and to allow an eventual pulling back of the cart during the passage of the cart in said access control device; a first cart identity checking device situated upstream of said access control device; a second cart identity checking device situated between the first checking device and the access control device for checking the cart identity when the cart passes the access control device; means for returning the access control device to an access prohibition position, a member sensitive to the access prohibition position of the access control device; and a unit connected to the said first and second checking devices and to said member for checking the correct sequential progress of the operation thereof and controlling a ticket delivering device.

9. An installation according to claim 8, wherein the first and second checking devices comprise respectively a photo-electric device having a transmitter and a receiver which are placed on either side of the cart passage way.

10. An installation according to claim 8, wherein the access control device comprises openable wickets having vertical outer edges which are constituted by rotatably mounted shafts, each shaft having a sector formed thereon with at least one perforation in which the core of an electromagnet is disposed for the purpose of locking the wicket.

11. An installation in accordance with claim 8, further comprising a summation counter with a reset to zero for counting the number of tickets distributed.

12. An installation in accordance with claim 8, wherein at least one of the cart identification devices comprises a component chosen from the group consisting of metal detectors, photo-electric cells of the reflection type, and receiving photo-electric cells associated with a distant element transmitting a radiation of predetermined wavelength.

13. An installation in accordance with claim 12, wherein the metal detector is placed on the access control device, so as to be brought substantially in contact with a portion of the cart when said vehicle is pushed against said access control device.

14. An installation in accordance with claim 13, wherein the access control device is of the two-leaf wicket type, each leaf carrying a metal detector.

15. An installation according to claim 13, wherein the reflection photo-electric cell is associated with a reflector carried by the cart.

16. An installation according to claim 12, wherein the reflection photo-electric cell is mounted on a fixed point separated from the cell by a space of which at least a portion is crossed by the cart.

17. An installation according to claim 12, wherein the cart forms the reflector associated with the photo-electric cell of the reflection type.

18. An installation according to claim 8, further comprising a vehicle conveyor controlled by the identification means following the introduction of the cart into a storage area.

19. An installation in accordance with claim 18, wherein the conveyor comprises two side belts with an outer serrated surface, extending on either side of the introductory passage of the cart to a storage area and capable of cooperating by the outer serrated surface thereof with the side walls of the cart for guiding the same.

20. An installation according to claim 19, wherein the two side belts are a variable distance from each other, and form a driving path which is narrowed toward an end opposite the entry end of the cart.

21. An installation in accordance with claim 18, wherein the conveyor is of a chain or belt type having on an outer surface perpendicular fingers for driving the vehicle by engagement of one portion of the cart by one of said fingers.

22. An installation according to claim 21, wherein the conveyor is placed slightly above ground, the fingers extending vertically for engaging a lower transverse bar of a cart when the latter is brought above the upstream end of the conveyor.

23. An installation according to claim 22, wherein the conveyor is preceded and followed by sloping planes facilitating the bringing of the cart at the entry of the conveyor and its removal at the outlet of the conveyor.

* * * * *